US006012944A

United States Patent [19]

Hatakeyama

[11] Patent Number: 6,012,944

[45] **Date of Patent: *Jan. 11, 2000**

[54] QUICK CONNECTOR AND QUICK CONNECTOR ASSEMBLY

[75] Inventor: Toshihiro Hatakeyama, Tokyo, Japan

[73] Assignee: Kyoshin Kogyo Co., Ltd., Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/974,428

[22] Filed: Nov. 19, 1997

[30] Foreign Application Priority Data

Jun. 4, 1997 [JP] Japan ..... 9-146765

[51] Int. Cl.[7] ..... H01R 4/24

[52] U.S. Cl. ..... 439/441; 439/857

[58] Field of Search ..... 439/67, 77, 439, 439/440, 441, 493, 495, 857

[56] References Cited

U.S. PATENT DOCUMENTS

| | | | |
|---|---|---|---|
| 4,403,272 | 9/1983 | Larson et al. | 439/85 |
| 4,722,579 | 2/1988 | Cummings et al. | 439/439 |
| 5,007,844 | 4/1991 | Mason et al. | 439/83 |
| 5,324,213 | 6/1994 | Frantz | 439/441 |
| 5,401,185 | 3/1995 | Wang et al. | 439/441 |
| 5,599,213 | 2/1997 | Frommer et al. | 439/857 |

FOREIGN PATENT DOCUMENTS

| | | | |
|---|---|---|---|
| 3118057 | 11/1982 | Germany | 439/441 |
| 64-670 | 1/1989 | Japan | 439/857 |

*Primary Examiner*—Ren Yan

[57] ABSTRACT

A quick connector includes a contact and a housing. The contact has a first contact piece, a second contact piece which cooperates with the first contact piece to hold a core wire of an electric wire, and leg portions which are electrically connected and mechanically fixed to a circuit board. The housing has a top wall thereof formed with a core-wire insertion hole and a guide hole, and a peripheral wall thereof defining therein an accommodation space in which portions, other than leg portions, of the first and second contact pieces are closely received. The quick connector permits easy insertion of an electric wire thereinto, adequately maintains electrical connection between itself and an electric wire inserted thereinto, is suitable to be automatically installed onto a circuit board, and is low priced.

2 Claims, 8 Drawing Sheets

QUICK CONNECTOR AND QUICK CONNECTOR ASSEMBLY

BACKGROUND OF THE INVENTION

1. Technical Field

The present invention relates to a quick connector adapted for easy insertion of a wire through which electrical connection is established between conduction paths formed in the same circuit board or different circuit boards or between a conduction path and a circuit component mounted on a circuit board which is the same as or different from a circuit board formed with the conduction path, and more particularly, to a quick connector arranged for easy insertion of a wire thereinto and adapted to securely maintain electric connection between the inserted wire and the connector, and a quick connector assembly suited to automatic insertion of a quick connector of this type into a circuit board by means of an automatic loader.

2. Related Arts

In constructing an electric circuit of electric equipment, a circuit board such as a printed circuit board is used intensively. In the case of using a printed circuit board to constitute an electric circuit, various electric circuit component parts are mounted on a printed circuit board formed with a conduction pattern. In an electric equipment comprised of printed circuit boards, a circuit component part mounted in a printed circuit board is sometimes required to be electrically connected to a specific portion of a conduction pattern formed in another printed circuit board. In such a case, the circuit component is generally connected with the specific portion of the conductor pattern through an electric wire extending from the circuit component, by inserting a terminal end of the wire into a connector mounted in advance on the specific portion of the conduction pattern.

As a connector of this type, a quick connector has been known which has one or more connector components which are resin-molded into one piece. Each connector component is designed to hold a wire once inserted thereinto, and includes a release mechanism for permitting the thus held wire to be detached therefrom by use of a screwdriver or the like.

The aforementioned quick connector is advantageous in that electric connection can be easily established between a conduction pattern and an electrical circuit component by simply inserting an electric wire into the connector component concerned. Thus, the efficiency in assembling mass-produced electric equipment can be improved by using quick connectors of this kind.

However, it is difficult to use an automatic loader in mounting the quick connectors on a printed circuit board, so that the connectors are usually mounted thereon manually. Such manual work hinders a further improvement in the efficiency of assemblage of electric equipment which includes quick connectors of this kind. Moreover, the quick connector which requires resin molding and which includes connector components each having a release mechanism is complicated in construction and high in costs.

SUMMARY OF THE INVENTION

An object of the present invention is to provide a low-priced quick connector which permits easy insertion of an electric wire thereinto and adequately maintain electric connection between the once inserted electric wire and the connector.

Another object of the present invention is to provide a quick connector assembly suited to automatic installation of quick connectors on a circuit board.

According to one aspect of the present invention, a quick connector comprising a contact and a housing is provided. The contact includes a first contact piece, a second contact piece which cooperates with the first contact piece to hold an electric wire, and a leg portion adapted to be electrically and mechanically connected with a circuit board. The housing includes a top wall thereof formed with a wire insertion hole through which the electric wire is inserted, and a peripheral wall thereof defining therein an accommodation space which closely receives at least those portions of the first and second contact pieces which are disposed on a side remote from the leg portion.

With the quick connector constructed as mentioned above, when an electric wire is inserted into the wire insertion hole formed in the top wall of the housing, the electric wire is held between the first and second contact pieces of the contact, to thereby establish electric connection between the contact and the electric wire. Further, at least those portions of the first and second contact pieces which are disposed on the side remote from the leg portion of the contact are closely received in the accommodation space of the housing, whereby a movement of each contact piece in the direction away from the other contact piece is restricted. This makes it possible to adequately maintain electric connection established between the contact and the electric wire. Moreover, the leg portion of the contact can be configured so as to be inserted into a through hole formed in a circuit board. Thus, the quick connector is suitable for automatic installation, by means of an automatic loader, of the connector onto the circuit board.

Preferably, the first contact piece has a first horizontal portion thereof extending in a depth direction of the connector, a first main portion thereof extending from the first horizontal portion in a longitudinal direction of the connector, a first bent portion thereof extending at an acute angle from the first main portion toward the first horizontal portion, and a first wire holding portion thereof extending from the first bent portion. The second contact piece has a second horizontal portion thereof extending in a direction away from the first horizontal portion, a second main portion thereof extending from the second horizontal portion in the longitudinal direction of the connector, a second bent portion thereof extending at an acute angle from the second main portion toward the second horizontal portion, and a second wire holding portion thereof extending from the second bent portion. The first and second wire holding portions have their distal ends which are disposed apart from each other at a distance which is less than a diameter of the electric wire.

With this preferred arrangement, easy insertion of the electric wire in between the distal ends of the first and second contact pieces can be achieved, and the electric wire once inserted in between the contact pieces can be securely held by means of spring forces of the contact pieces, whereby adequate electrical connection can be established between the contact pieces and the electric wire.

Preferably, the accommodation space closely receives therein those portions of the first and second contact pieces other than the leg-portion side portions of the contact pieces.

With this arrangement, the peripheral wall of the housing and the first horizontal portion of the first contact piece cooperate with the second horizontal portion of the second contact piece to define a space whose circuit-board side is closed and which closely receives those portions, other than the leg-portion side portions, of the first and second contact pieces. Thus, even if electric wire chippings are produced when the electric wire is inserted in between the first and second contact pieces or when the electric wire is pulled, the electric wire chippings are prevented from falling onto the circuit board, thereby preventing a short circuit, attributable to the electric wire chippings, of conduction paths formed in the circuit board.

Preferably, the electric wire is comprised of a covered wire having a core wire covered by a sheath. The wire insertion hole permits the core wire of the covered wire to pass therethrough. The top wall of the housing is formed with a guide hole in alignment with the wire insertion hole, the guide hole permitting the covered wire to pass therethrough.

With this arrangement, the electric wire can be easily and accurately inserted into the wire insertion hole with the aid of a guide function of the guide hole.

Preferably, the top wall of the housing is formed with a first recess for receiving the first bent portion of the first contact piece, and a second recess for receiving the second bent portion of the second contact piece.

With this arrangement, a movement of each contact piece in a direction away from the other contact piece is prevented, whereby the electric connection between the contact pieces and the electric wire can be maintained properly.

Preferably the first main portion of the first contact piece has an engagement piece which extends from the main portion obliquely outwardly. The peripheral wall of the housing is formed with a slit which extends in the longitudinal direction of the connector. The slit has a closed end thereof located on a side away from the top wall of the housing. When the contact is received in the accommodation space of the housing, a distal end of the engagement piece of the first contact piece is in contact with the closed end of the slit.

With this arrangement, when the assembling of the quick connector is once finished by inserting the contact into the housing, the engagement piece on the contact side is brought in engagement with the closed end of the slit formed in the peripheral wall of the housing, whereby the contact is prevented from being detached from the housing.

Preferably, the electric wire is comprised of a covered wire which has a core wire covered with a sheath. The first and second wire holding portions of the first and second contact pieces have their distal ends which cooperate with each other to hold the core wire of the covered wire. The first and second contact pieces have first and second electric-current-path forming pieces, respectively. The first and second electric-current-path forming pieces have their distal ends thereof disposed to face each other and to be apart from each other at a distance less than an outer diameter of the core wire of the electric wire.

With this arrangement, electric currents are permitted to flow between the quick connector and the electric wire through the first and second electric-current-path forming pieces, in addition to the electric current flow through the first and second wire holding portions. Thus, a quick connector for heavy current use can be provided.

According to another aspect of the present invention, there is provided a quick assembly which comprises a mount base formed with plural holes which are arranged at a regular interval and into which feed pawls of an automatic loader are individually engagedly fitted, and a plurality of quick connectors which are mounted on the mount base at a regular interval. Each of the quick connectors is configured as mentioned above in respect of the first aspect of the invention.

The quick connector assembly constructed as mentioned above is suited to an automatic installation, by means of an automatic loader, of a quick connector onto a circuit board.

DETAILED DESCRIPTION

With reference to the appended drawings, a quick connector and a quick connector assembly according to a first embodiment of the present invention will be explained.

Figure 2:
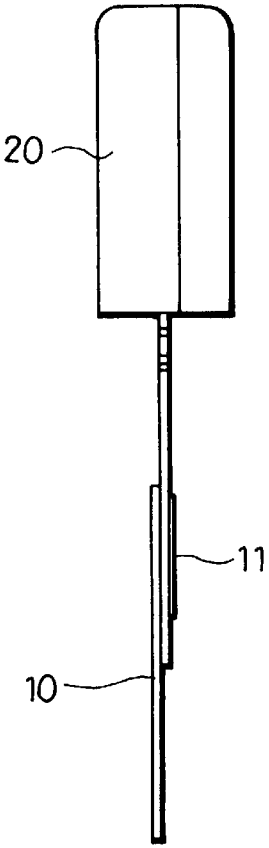
FIG. 2 is a side view of the connector assembly shown in FIG. 1.
Figure 1:
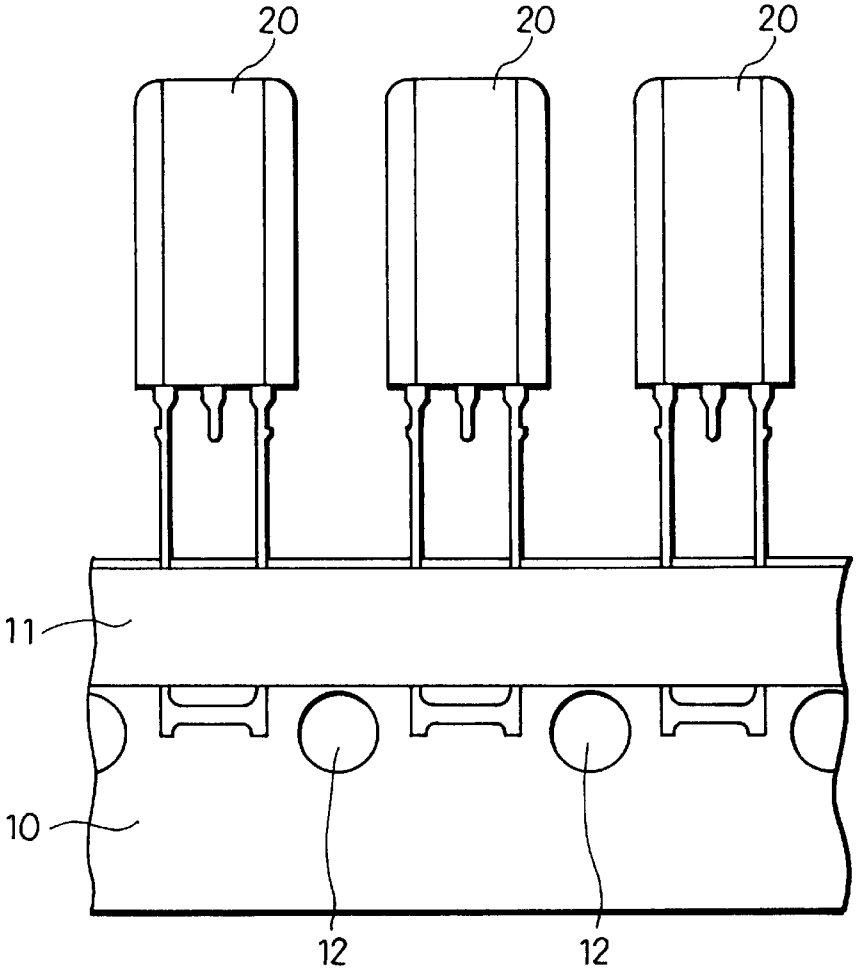
FIG. 1 is a fragmentary front view showing a quick connector assembly according to a first embodiment of the present invention.

Referring to FIGS. 1 and 2, the quick connector assembly 1 comprises a mount base 10 and a number of quick connectors 20 which are separate from the mount base. These connectors 20 are affixed to the mount base 10 at a regular interval by means of a tape 11. The mount base 10 is formed, at a regular interval, with a number of perforations 12 into which feed pawls of a sprocket of an automatic connector loader (not shown) which is comprised of, e.g., a commercially available automatic electric component loader are engaged, so that the connector assembly 1 is transferred with the rotation of the sprocket.

Each connector 20 of the connector assembly 1 is connected and secured to a conductor path 16 provided in a circuit board 13 (e.g., a conductor pattern formed in a printed circuit board), and serves to electrically connect the conductor path 16 with an electric wire 23 inserted into the connector 20.

Figure 11:
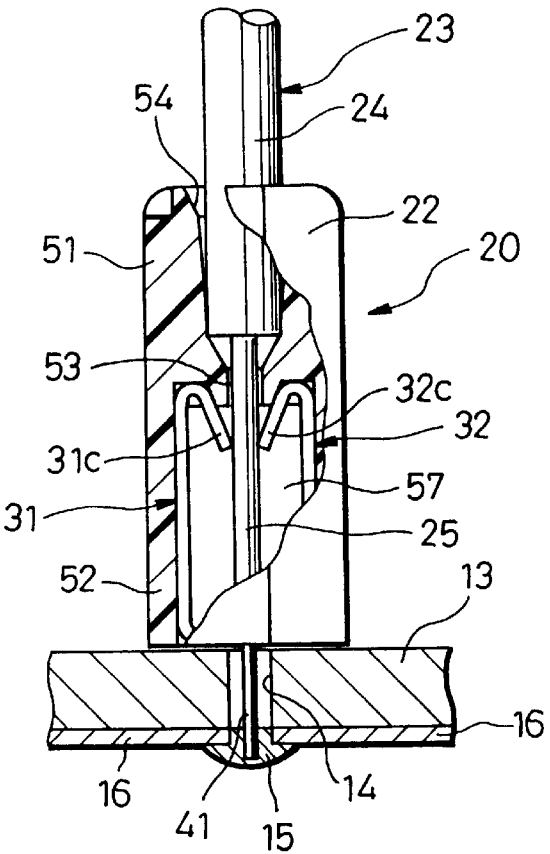
FIG. 11 is a fragmentary sectional side view showing the quick connector shown in FIG. 10 in a state where the quick connector is mounted on a circuit board.
Figure 10:
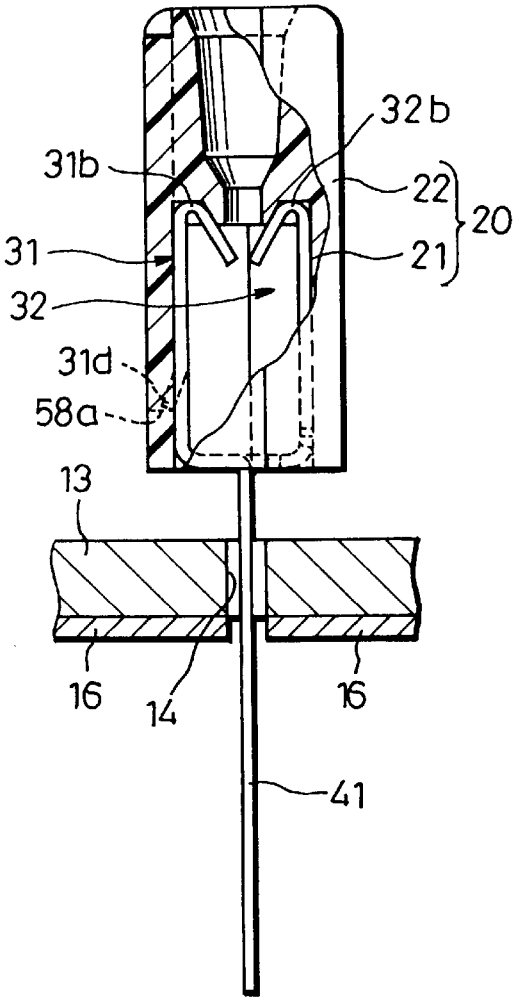
FIG. 10 is a fragmentary sectional side view showing the quick connector, comprised of the contact shown in FIGS. 3 to 5 and the housing shown in FIGS. 6 to 9, in a state where leg portions of the connector are being inserted into through holes formed in a circuit board.

As shown in FIGS. 10 and 11, each of the connectors 20 has a contact 21 thereof electrically connected to and mechanically fixed to the circuit board 13, and a housing 22 for receiving most parts of the contact 21.

Figure 4:
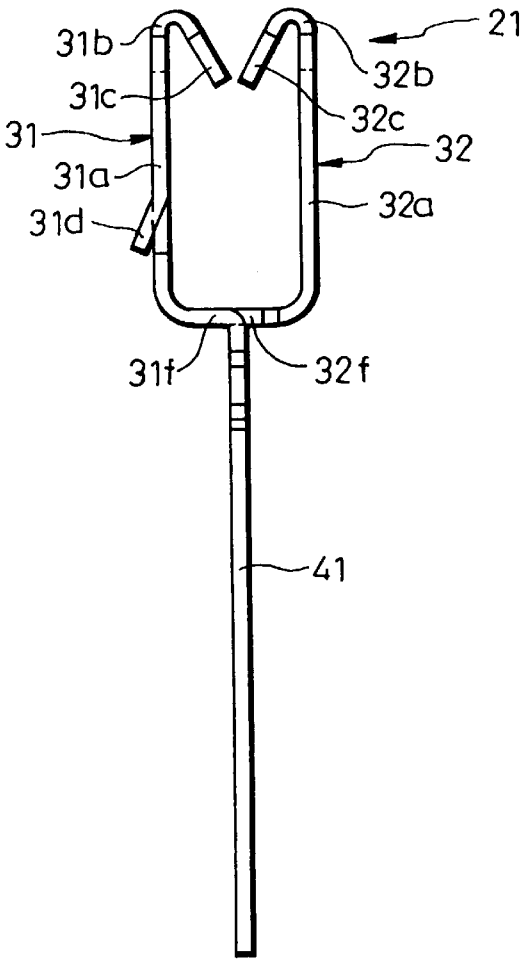
FIG. 4 is a side view of the contact shown in FIG. 3.
Figure 3:
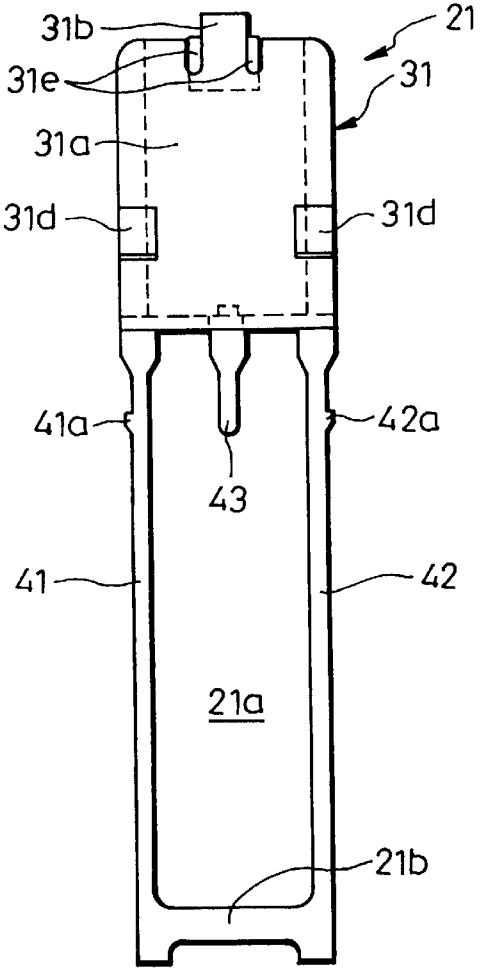
FIG. 3 is a front view showing a contact, which is a primary element of the quick connector shown in FIGS. 1 and 2, in a state that the contact is provided with a coupling portion through which first and second leg portions are coupled to each other.
Figure 7:
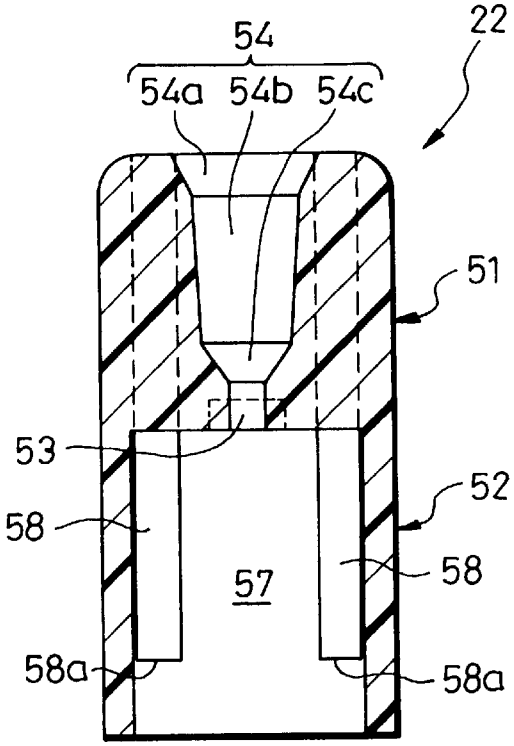
FIG. 7 is a sectional front view of the housing shown in FIG. 6.
Figure 6:
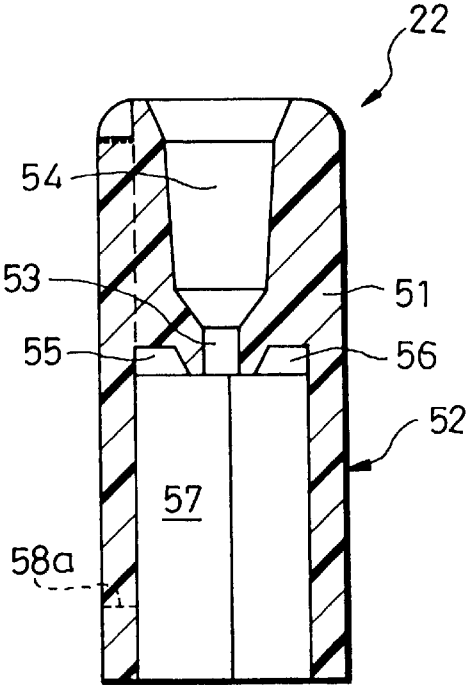
FIG. 6 is a sectional side view of a housing which is a primary element of the quick connector shown in FIGS. 1 and 2.
Figure 5:
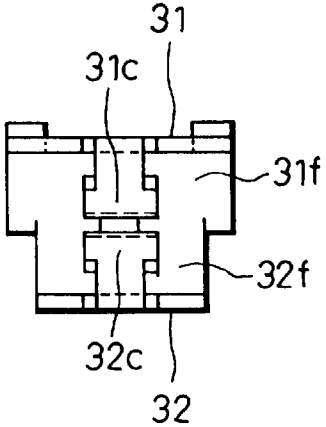
FIG. 5 is a top view of the contact shown in FIGS. 3 and 4.
Figure 9:
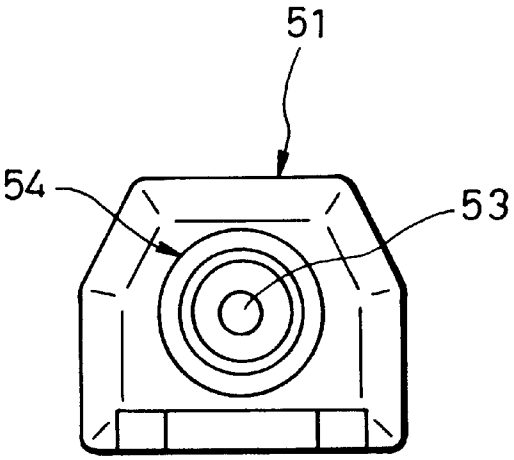
FIG. 9 is a top view of the housing shown in FIGS. 6 to 8.
Figure 8:
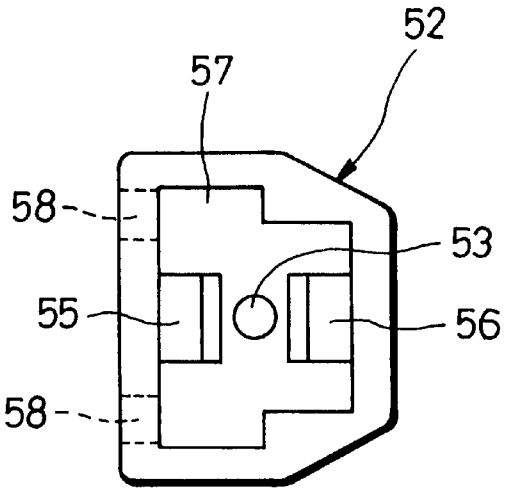
FIG. 8 is a bottom view of the housing shown in FIGS. 6 and 7.

As shown in FIGS. 3 to 5, the contact 21 has first and second contact pieces 31, 32 and first, second and third leg portions 41, 42, 43. Preferably, the contact 21 is obtained from a single metal sheet by subjecting this sheet to a forming process. The second contact piece 32 is comprised of a sheet portion (indicated by reference numeral 21*a* in FIG. 3), defined by the first contact piece 31 and the first and second leg portions 41, 42, of the metal sheet. The third leg portion 43 is formed by part of the sheet portion 21*a*.

The first contact piece 31 has a horizontal portion 31*f* thereof extending in the depth direction of the connector, a main portion 31*a* thereof extending from the horizontal portion 31*f* in the height direction of the connector (more generally, in the longitudinal direction of the connector), a bent portion 31*b* thereof extending at an acute angle from the main portion 31*a* toward the horizontal portion 31*f* inwardly of the connector, and a core-wire holding portion (more generally, a wire holding portion) 31*c* thereof extending from the bent portion 31*b*. These elements 31*f*, 31*a*, 31*b* and 31*c* of the first contact piece 31 are formed into one piece.

The main portion 31*a* of the first contact piece 31 has two engagement pieces 31*d* which extend obliquely and outwardly from the main portion 31*a* to the side remote from the top wall 51 of the housing. These engagement pieces 31*d* are formed by raising associated cut parts of the main portion 31*a* of the contact.

As in the case of the first contact piece 31, the second contact piece 32 has a horizontal portion 32*f* thereof extending horizontally in the direction away from the horizontal portion 31*f* of the first contact piece 31, a main portion 32*a* thereof extending from the horizontal portion 32*f* in parallel with the main portion 31*a* of the first contact piece 31 in the height direction of the connector, a bent portion 32*b* thereof extending at an acute angle from the main portion 32*a* toward the horizontal portion 32*f* inwardly of the connector, and a core-wire holding portion 32*c* thereof extending from the bent portion 32*b*. These elements 32*f*, 32*a*, 32*b* and 32*c* are formed into one piece.

The core-wire holding portions 31*c* and 32*c* of the first and second contact pieces 31 and 32 have their distal ends which are disposed to face each other and to be apart from each other at a distance which is less than the outer diameter of the core-wire 25 of the electric wire 23. As shown in FIG. 11, the distal ends of the core-wire holding portions 31*c* and 32*c* cooperate with each other to hold the core wire 25 of the electric wire 23. In FIG. 11, reference numeral 24 denotes a sheath which covers the core wire 25 of the electric wire 23.

Referring to FIG. 3, at a boundary portion between the main portion 31*a* and the bent portion 31*b* of the first contact piece 31, the bent portion 31*b* is formed at its opposite sides with grooves 3*e*. Likewise, the second contact piece 32 is formed with similar grooves (not shown). As a consequence, spring forces produced by the bent portions 31*b* and 32*b* of the first and second contact pieces 31 and 32 are decreased, so as to permit easy insertion of the core wire 25 in between the contact pieces 31 and 32.

As shown in FIGS. 3 and 4, the first, second and third leg portions 41, 42 and 43 extend in the direction away from the first and second contact pieces 31 and 32, and are adapted to be inserted into three through holes (one of which is shown by reference numeral 14 in FIG. 11) formed separately in the print circuit board 13, respectively. The first, second and third leg portions 41, 42 and 43 are formed into, e.g., a rectangular shape in cross section, and the through hole 14 of the print circuit board 13 is preferably comprised of a round-hole. The first and second leg portions 41 and 42 are integrally formed with stopper knots 41*a* and 42*a*, respectively, which project outward in the width direction of the connector.

The housing 22 is obtained by injection-molding synthetic resin, for instance, and has a top wall 51 and a peripheral wall 52.

The top wall 51 of the housing is formed with a core-wire insertion hole (more generally, a wire insertion hole) 53 which extends along the longitudinal axis of the connector and into which the core-wire 25 of the electric wire 23 is inserted. Further, the top wall 51 is formed with a guide hole 54 in alignment with the core-wire insertion hole 53 into which the covered wire 23 is inserted. The guide hole 54 is comprised of a first tapered hole 54*a* which opens to the top surface of the housing 22, a second tapered hole 54*b* communicated with the first tapered hole 54*a*, and a third tapered hole 54*c* communicated with the second tapered hole 54*b* and the core-wire insertion hole 53. At the boundary between the second and third tapered holes 54*b* and 54*c*, the guide hole 54 has an inner diameter which is substantially the same as the outer diameter of the core wire 25 of the electric wire 23, so that a further insertion of the covered wire 23 toward the core-wire insertion hole 53 is prevented.

The top wall 51 of the housing has a bottom surface thereof formed with first and second recesses 55 and 56 in which mainly a first bent portion 31*b* of the first contact piece 31 and a second bent portion 32*b* of the second contact piece 32 are respectively received. Once the bent portions 31*b* and 32*b* of the contact pieces 31 and 32 have been received, a movement of the respective contact piece in the direction away from the other contact piece is prevented, whereby the core-wire holding by means of these two contact pieces is ensured.

The peripheral wall 52 of the housing defines therein an accommodation space 57 which receives portions, other than leg portions 41, 42 and 43, of the first and second contact pieces 31 and 32. Among front, rear, right and left wall portions constituting the peripheral wall 52 of the housing, the peripheral wall portion which is disposed to face a main portion 31 of the first contact piece is formed with two slits 58 which extend in the height direction of the connector. These slits 58 each have a closed end 58*a* thereof located on the side remote from the top wall of the housing, and another end which opens to the top surface of the housing. When the contact 21 is received in the accommodation space 57 of the housing 22, a distal end portion of an engagement piece 31*d* formed in the contact 21 is disposed in the slit 58, with the distal end of the engagement piece 31*d* brought in contact with the closed end 58*a* of the slit 58, whereby the contact 21 is prevented from being detached from the housing 22.

Figure 12:
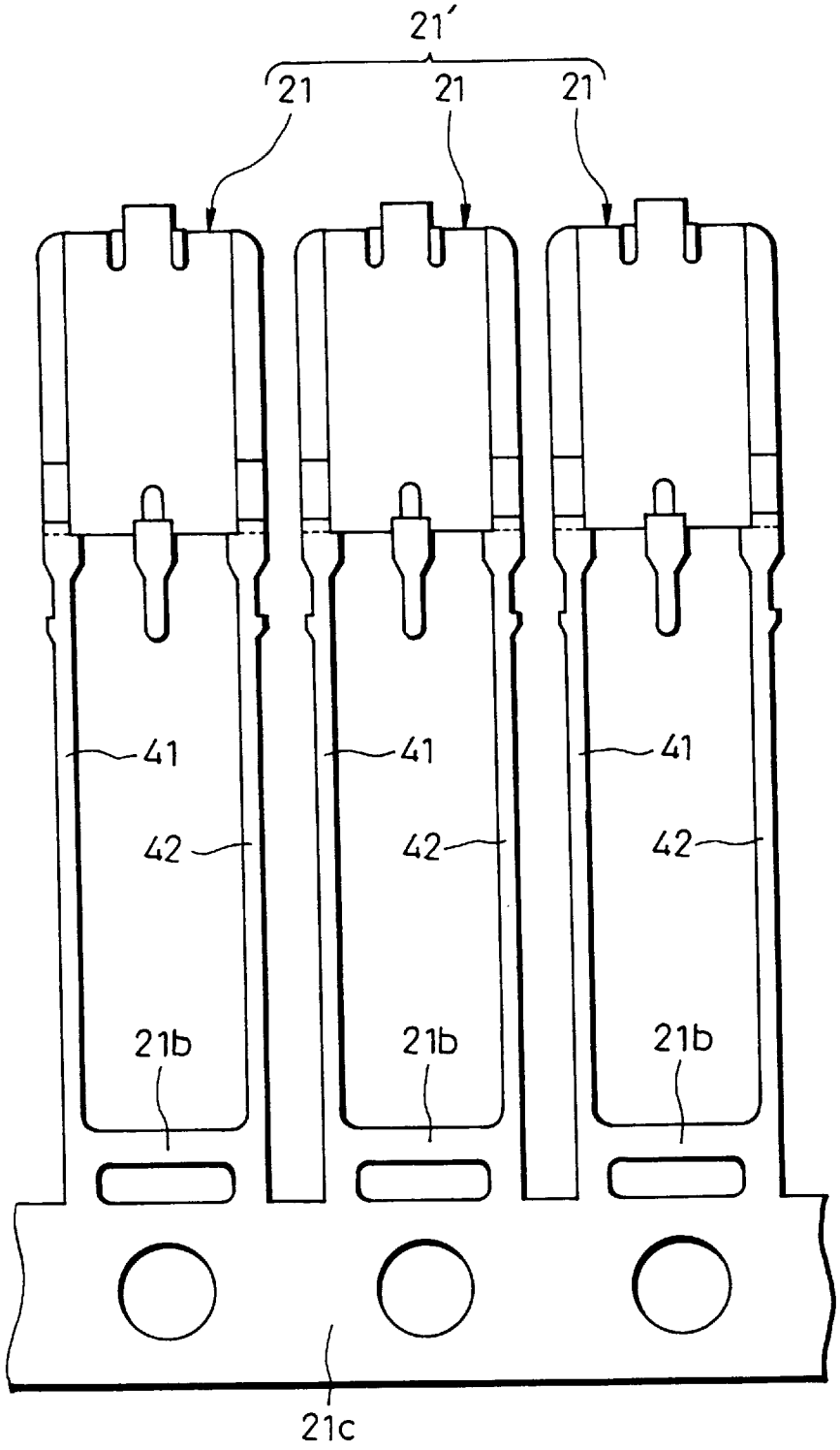
FIG. 12 is a fragmentary front view showing a formed contact strip which is obtained during the course of manufacturing a contact.

In manufacturing the connector assembly 1 having the construction described above, an unfinished contact strip (not shown), which is comprised of a plurality of unfinished contacts and a frame potion 21*c* (FIG. 12) formed integrally therewith, is first punched from a metal strip (not shown)

which is formed of brass or the like, by means of a press molding machine (not shown) furnished with a multi-station mold (forward-feed mold), for example. Then, the individual parts of each contact are formed in sequence, to thereby obtain a formed contact which is denoted by reference numeral 21' in FIG. 12. Subsequently, the frame portion 21*c* is cut off from the contact 21', to thereby obtain a plurality of contacts 21. Moreover, the thus obtained contacts 21 are arranged on the mount 10 at the same intervals as perforation intervals L in a such manner that each contact 21 is situated halfway between each two adjacent perforations 12 which are bored through the mount 10. Then, respective leg portions of these contacts 21 are stuck to the mount 10 by means of an adhesive tape 11. Finally, a housing 22 is fitted on each contact 21, whereby a plurality of connectors 20 (FIG. 1) which are coupled to one another through the mounting 10 is obtained.

In mounting the connectors 20 on the printed board 40, the perforations 12 of the mount 10 of the connector assembly 1 are caused to engage the feed pawls of the sprocket of the automatic loader, and the loader is then actuated to rotate the sprocket. By doing this, the assembly 1 is transported to the position where its leading connector 21 faces a chuck (not shown) of the loader.

After the leading connector 21 is held by the chuck, the chuck is moved so that the connector assembly 1 is delivered to the position where it faces a cutter (not shown) of the loader. Then, the connector assembly 1 is cut along the boundary between the leading connector 20 and its subsequent one by means of the cutter, whereby a combination of the leading connector 20 and the mount associated therewith is separated from the connector assembly 1. After the chuck is horizontally turned to rotate the combination through 90 degrees around the cutter, a coupling portion 21*b* is cut off from the connector 21 by means of the cutter.

Subsequently, the chuck is moved to locate the connector 20 in a position such that its leg portions 41, 42 and 43 face through holes 14 of the printed board 13, respectively. Thereafter, the chuck is moved so that the leg portions are inserted individually into the through holes (FIG. 10). After the chuck is released so that the connector 20 is disengaged from the chuck, the connector 20 is pressed by means of a pusher (not shown) of the automatic loader so that the leg portions 41, 42 and 43 are further pushed into their corresponding through holes 14. By doing this, the bottom surface of the housing 22 of the connector 20 and the bottom surfaces of the horizontal portions 31*f* and 32*f* of the connector pieces 31 and 32 are caused to abut against the upper surface of the printed circuit board 13. Then, extra parts of the leg portions 41, 42 and 43 are cut off, and the respective distal end portions of the leg portions 41, 42 and 43 which project from the printed circuit board 13 are clinched. Thereupon, automatically loading the printed circuit board 13 with the leading connector 20 is finished.

As in the case of the leading connector 20, the printed circuit board 13 is automatically loaded with the subsequent connectors 20. Then, the leg portions 41, 42 and 43 of each connector 20 are connected electrically and mechanically fixed to the conductor pattern of the printed circuit board 13 by flow soldering using a molten solder bath, as shown by reference numeral 15 in FIG. 11. The holes 14 of the printed circuit board 13 into which the leg portions 41, 42 and 43 of the connector 20 are inserted are formed separately from one another, so that they have a small diameter. Even if the printed circuit board 13 is subjected to an external force during operation, it is less likely to be damaged. Moreover, each leg portion 41, 42 or 43 has a narrow cross section and hence a small thermal capacity, so that the flow soldering can be carried out properly. Since the leg portions 41 and 42 of the connector 20 are formed with the stopper knots 41*a* and 42*a*, respectively, they can bite solder efficiently.

Since mounting the connector 20 on the printed circuit board 13 is thus automated, the necessity of manual operation is obviated, and the cost can be reduced.

Figure 14:
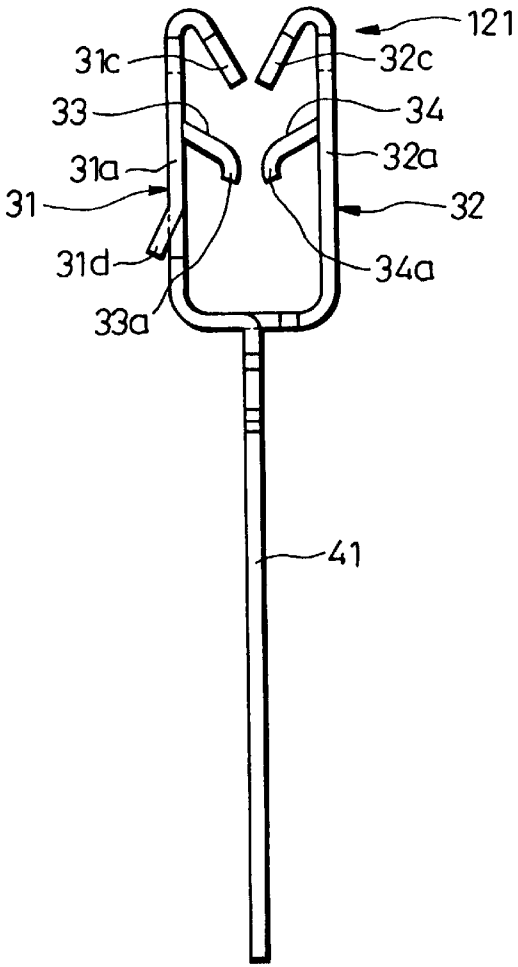
FIG. 14 is a side view of the contact shown in FIG. 13.
Figure 13:
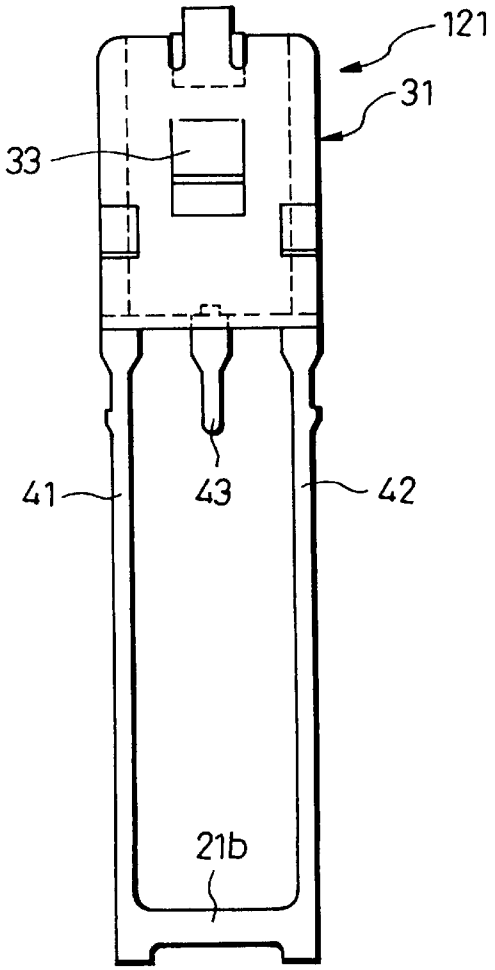
FIG. 13 is a front view showing a contact, which is a primary element of a quick connector according to a second embodiment of the present invention, in a state where the contact is provided with a coupling portion.
Figure 15:
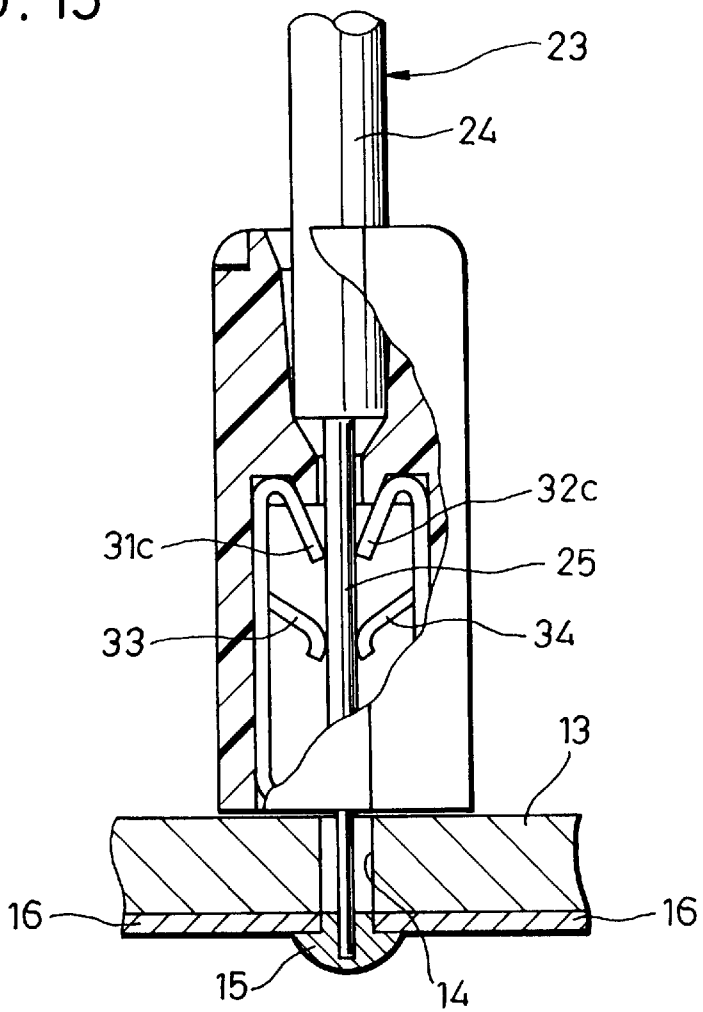
FIG. 15 is a fragmentary sectional side view showing a quick connector, having the contact shown in FIGS. 13 and 14, in a state where the quick connector is mounted on a circuit board.

In the following, a quick connector according to a second embodiment of the present invention will be explained with reference to FIGS. 13 and 14.

The quick connector of this embodiment contemplates permitting transfer of an intensity electric current between a circuit board and an electric wire through the connector. To this end, as shown in FIG. 14, first and second contact pieces 31 and 32 have first and second electric-current-path forming pieces 33 and 34, respectively. The first electric-current path forming piece 33 extends obliquely inwardly from a main portion 31*a* of the first contact piece 31. The first electric-current-path forming piece 33 and the main portion 31*a* form therebetween an acute angle which is larger than an angle formed between a wire holding portion 31*c* and the main portion 31*a*. Likewise, the second electric-current-path forming piece 34 obliquely inwardly extends from the main portion 32*a* of the second contact piece 32. The second electric-current-path forming piece 34 and the main portion 32*a* form an acute angle which is larger than an angle formed between the wire holding portion 32*c* and the main portion 32*a*.

The first and second electric-current-path forming pieces 33 and 34 have their distal ends disposed to face each other at a distance which is smaller than the outer diameter of the core wire 25 of the electric wire 23, so that the electric-current-path forming pieces 33 and 34 adequately maintain a state wherein these pieces 33 and 34 are in urged contact with the core wire 25 inserted in between them. Distal end portions 33*a* and 34*a* of the first and second electric-current-path forming pieces 33 and 34 are formed to be curved convexly toward the core wire 25 so as to permit easy insertion of the core wire 25 in between these elements 33 and 34.

As explained in the above, the provision of the first and second electric-current-path forming pieces 33 and 34 permits the transfer of electric current between the quick connector 20 and the electric wire 23 through these pieces 33 and 34, in addition to the electric current transfer therebetween through the wire holding portions 31*c* and 32*c* of the first and second contact pieces 31 and 32. Thus, the quick connector can be subject to a heavy-current use.

The remaining elements of the quick connector of this embodiment are the same in construction, function and advantage as those of corresponding elements of the connector according to the first embodiment, and hence explanations as to the remaining connector elements will be omitted herein.

What is claimed is:

1. A quick connector, comprising:

a contact formed from one integral piece of material including a first contact piece, a second contact piece which cooperates with said first contact piece to hold an electric wire, and a leg portion which is adapted to be electrically connected with and mechanically fixed to a circuit board; and a housing including a top wall thereof formed with a wire insertion hole through which the electric wire is inserted, and a peripheral wall thereof defining therein an accommodation space which closely receives at least those portions of said first and second contact pieces which are disposed on a side remote from said leg portion, said first contact piece having a first horizontal portion thereof extending in a depth direction of the connector, a first main portion thereof extending from said first horizontal portion in a longitudinal direction of the connector, a first bent portion thereof extending at an acute angle from said first main portion toward said first horizontal portion, and a first wire holding portion thereof extending from said first bent portion;

said second contact piece having a second horizontal portion thereof extending in a direction away from the first horizontal portion, a second main portion thereof extending from said second horizontal portion in the longitudinal direction of the connector, a second bent portion thereof extending at an acute angle from said second main portion toward said second horizontal portion, and a second wire holding portion thereof extending from said second bent portion;

said first and second wire holding portions having their distal ends facing each other and disposed apart from each other at a distance less than an outer diameter of the electric wire;

said accommodation space closely receiving therein portions of said first and second contact pieces other than the leg-portions of said contact pieces;

wherein the electric wire is comprised of a covered wire which has a core wire covered with a sheath;

wherein said first and second wire holding portions of said first and second contact pieces have their distal ends which cooperate with each other to hold the core wire of the covered wire; and wherein said first contact piece has a first electric-current-path forming piece formed integrally therewith at a position spaced from said first wire holding portion and in-line with said first wire holding portion with respect to the longitudinal direction of said contact, and said second contact piece has a second electric-current-path forming piece formed integrally therewith, at a position spaced from said second wire holding portion and in-line with said second wire holding portion with respect to the longitudinal direction of said contact, said first and second electric-path forming pieces having their distal ends thereof facing each other and apart from each other at a distance less than an outer diameter of the electric wire.

2. A quick connector assembly, comprising:

a mount formed with plural holes which are arranged at a regular interval and into which feed pawls of an automatic loader are individually engagedly fitted; and a plurality of quick connectors which are mounted on said mount at a regular interval, each of said quick connectors including a contact and a housing;

wherein said contact includes a first contact piece, a second contact piece which cooperates with said first contact piece to hold an electric wire, and a leg portion which is adapted to be electrically connected with and mechanically fixed to a circuit board;

wherein said housing includes a top wall thereof formed with a wire insertion hole through which the electric wire is inserted, and a peripheral wall thereof defining therein an accommodation space which closely receives at least those portions of said first and second contact pieces which are disposed on a side remote from said leg portion;

said first contact piece having a first horizontal portion thereof extending in a depth direction of the connector, a first main portion thereof extending from said first horizontal portion in a longitudinal direction of the connector, a first bent portion thereof extending at an acute angle from said first main portion toward said first horizontal portion, and a first wire holding portion thereof extending from said first bent portion;

said second contact piece having a second horizontal portion thereof extending in a direction away from the first horizontal portion, a second main portion thereof extending from said second horizontal portion in the longitudinal direction of the connector, a second bent portion thereof extending at an acute angle from said second main portion toward said second horizontal portion, and a second wire holding portion thereof extending from said second bent portion; and said first and second wire holding portions having their distal ends facing each other and disposed apart from each other at a distance less than an outer diameter of the electric wire;

said accommodation space closely receiving therein portions of said first and second contact pieces other than the leg-portions of said contact pieces; and a strip of adhesive tape for securing the leg portions of the contacts to the mount;

wherein the electric wire is comprised of a covered wire which has a core wire covered with a sheath;

wherein said first and second wire holding portions of said first and second contact pieces have their distal ends which cooperate with each other to hold the core wire of the covered wire; and wherein said first contact piece has a first electric-current-path forming piece formed integrally therewith at a position spaced from said first wire holding portion and in-line with said first wire holding portion with respect to the longitudinal direction of said contact, and said second contact piece has a second electric-current-path forming piece formed integrally therewith, at a position spaced from said second wire holding portion and in-line with said second wire holding portion with respect to the longitudinal direction of said contact, said first and second electric-path forming pieces having their distal ends thereof facing each other and apart from each other at a distance less than an outer diameter of the electric wire.

* * * * *